US006218654B1

(12) United States Patent
Braunisch

(10) Patent No.: US 6,218,654 B1
(45) Date of Patent: Apr. 17, 2001

(54) FLOW CONTROL DEVICE FOR A VENTILATOR HOOD

(75) Inventor: Eckart Wilholm Braunisch, Kimstad (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/462,924

(22) PCT Filed: Jun. 18, 1998

(86) PCT No.: PCT/EP98/03675

§ 371 Date: Jan. 14, 2000

§ 102(e) Date: Jan. 14, 2000

(87) PCT Pub. No.: WO99/04201

PCT Pub. Date: Jan. 28, 1999

(30) Foreign Application Priority Data

Jul. 17, 1997 (SE) ..... 9702742

(51) Int. Cl.[7] ..... H05B 6/80

(52) U.S. Cl. ..... 219/757; 219/400; 126/21 A; 126/299 D

(58) Field of Search ..... 219/757, 400; 126/21 A, 299 R, 299 D, 273 R, 275 E

(56) References Cited

U.S. PATENT DOCUMENTS 4,418,261 * 11/1983 Jailor et al. ..... 219/757
4,618,756 * 10/1986 Schwaderer et al. ..... 219/757
5,500,508 * 3/1996 Gerl ..... 219/757

FOREIGN PATENT DOCUMENTS 41 43 124 * 7/1992 (DE) .
2 028 491 * 3/1980 (GB) .
2 176 378 * 12/1986 (GB) ..... 219/757

* cited by examiner

*Primary Examiner*—Philip H. Leung
(74) *Attorney, Agent, or Firm*—Robert O. Rice; Joel M. Van Winkle; Stephen D. Krefman

(57) ABSTRACT

In a common casing, a domestic appliance comprises an oven (60) and a ventilator device (20). The ventilator device (20) has a ventilating duct (21) extending between at least one inlet opening (23) and at least one outlet opening (24, 25) on the outside of the casing (50). A ventilator (22) arranged in the ventilating duct (21) is stationarily mounted in the casing (50) spaced from the outlet opening (24, 25). A flow control means (30) is arranged in the casing (50) downstream of the ventilator (22) for adjusting the duct (21) to lead out at any one of at least two outlet locations (16, 17, 18). A suitable flow control means (30) has an elongated control means housing (39) and comprises an outlet opening (32) and an inlet opening (31). The outlet opening (32) is arranged along a long side and the inlet (31) opening is arranged along another side and has a smaller opening area than the outlet opening (32). A deflecting device (40) is arranged in the flow control means (30) for deflecting and distributing the flow essentially uniformly at the outlet opening (32).

8 Claims, 4 Drawing Sheets

FLOW CONTROL DEVICE FOR A VENTILATOR HOOD

TECHNICAL FIELD

The present invention relates to a domestic appliance comprising an oven and a ventilator device in a common casing according to the preamble of the appended claim 1 and a flow control means and the use thereof in such an appliance.

PRIOR ART

Domestic appliances which in a common unit comprise a microwave oven and a ventilator hood are previously known. Such combinations of a ventilator hood and a microwave oven are intended to be installed over a range and offer efficient utilisation of the space above a range.

Usually, the ventilating duct in such domestic appliances has an outlet which at the time of installation is adjustable to suit various designs and placements of subsequent kitchen flues in a building. Often, as an alternative, the outlet of the ventilating duct can guide the flow in the duct to recirculation, e.g. when the building lacks a suitable kitchen flue, so that the ventilator hood can function as a recirculation ventilator, together with a suitable filter.

These known domestic appliances have a ventilator unit arranged directly opposite an outlet opening. Usually, the outlet opening is formed as a rectangular opening in the transition area between the top and back of the appliance. In this connection, the ventilator unit is formed as a radial ventilator with twin rotors, which are arranged on each side of a centrally located electric motor. The ventilator has a horizontal rotation axis extending in the transverse direction of the appliance. The diameter of the rotors essentially corresponds to the dimension of the outlet opening in the direction upwards-downwards or forwards-backwards. The ventilator unit forms a rectangular parallelepiped and can be placed in different turning positions around its rotation axis for adjustability between outlet upwards or backwards to a ventilating duct in the building or for outlet forward through a second outlet opening on the front of the appliance for recirculation.

One problem associated with this known construction is that the ventilator and the air currents give rise to high sound levels.

Furthermore, there are special problems associated with ventilator devices which are combined with an oven, such as combining a number of appliance components and ventilating ducts in a limited volume in a common casing. Therefore, there are problems of low ventilator efficiency because of uncontrolled flow in the appliance. In known appliances, a high percentage of the air which is blown out through the ventilator leaks into the outer casing of the appliance from a different location than the intended inlet opening.

SUMMARY OF THE INVENTION

The object of the present invention is to achieve an improved ventilator device in a domestic appliance comprising an oven and a ventilator device in a common casing.

In this connection, special objects are to lower the sound level of the ventilator device and to achieve improved controllability of air currents in the appliance.

These and other objects, which can be seen from the description below, have now been achieved by the invention by means of a domestic appliance and a flow control means, which are of the kind described in the introduction and which in addition have the features stated in the characterising clauses of claims 1 and 9, and by a use of the flow control means according to claim 16.

Thus, in the domestic appliance according to the invention, the ventilator is stationarily mounted on the inside of the casing, spaced from an outlet opening.

In addition, the ventilating duct has a flow control means arranged downstream of the ventilator on the inside of the casing for adjusting the ventilating duct to lead to any one of at least two different outlet locations.

In this way, it becomes possible to choose the location and the design of the ventilator inside the casing or cover of the appliance. For example, the ventilator can be given a larger radius or be located closer to the intake opening of the appliance. Greater possibilities are afforded for the design of a suitable ventilating duct in coaction between the ventilator and the other components of the appliance. In addition, it becomes possible to utilise a larger part of the area of the outlet opening for the outlet air, which means that an equally large volume flow rate can be ventilated at lower outlet velocities. This, in turn, leads to lower sound levels than have been possible in known appliances, in which ventilator constructions only allow a smaller part of the outlet opening to be utilised.

In a preferred embodiment the flow control means is adapted to change the direction of a flow in the ventilating duct. As a result, the adjustability of the flow control means and the optional location of the ventilator can be achieved in a simple way by the fact that the flow control means can be placed in various turning positions around an intake from the ventilator.

In a particularly preferred embodiment, the flow control means has a control means housing with a smaller inlet and a larger outlet in order to function as a diffuser. In this way, the velocity of flow in the outlet can be lowered, which leads to lower sound levels. At the same time, the ventilating duct can be given a limited cross-sectional area between the ventilator and the flow control means.

It is a preferred feature that the ventilator be given a relatively large radius, larger than the smallest dimension of the outlet opening, something which has been the case in the known solutions. By virtue of a larger radius, the peripheral speed of the ventilator can be reduced in relation to the flow rate, which leads to lower rotation speeds and thus lower sound levels. It is a particularly preferred feature that the ventilator be arranged in the form of a radial ventilator which rotates around an asymmetrically located, vertical rotation axis in an upper area of the appliance. In this way, the radius of the ventilator will only be limited by the horizontal cross-sectional dimensions of the appliance.

A flow control means according to the invention has an elongated control means housing and comprises an outlet opening, which is arranged along a long side, and an inlet opening, which is arranged along another side. The inlet opening has a smaller opening area than the outlet opening. In addition, a deflecting device is arranged to deflect and distribute the flow essentially uniformly at the outlet.

Such a flow control means has proved to be extremely suitable for controlling a flow to an outlet opening in a domestic appliance with a ventilator in combination with an oven. The flow control means according to the invention also affords great advantages in appliances which have a fixed outlet location.

In a preferred embodiment, the deflecting device comprises a plurality of deflecting means, which are essentially uniformly arranged along a projection of the inlet opening perpendicular to its essential geometrical plane and at the same time essentially uniformly arranged along a projection of the outlet opening perpendicular to its essential geometrical plane. In this way, deflection of the air current as well as a reduction of velocity and a uniform distribution of the same over the larger area of the outlet are achieved with a small loss of energy.

The deflecting means of the flow control means preferably comprises deflecting blades which are somewhat curved and have a leading edge facing the inlet opening and a trailing edge facing the outlet opening. In order to achieve good flow characteristics and little energy loss, it is particularly preferred that the leading edge of the blades be rounded and that the trailing edge be pointed.

BRIEF DESCRIPTION OF THE DRAWINGS

The invention will be described in more detail below with reference to the accompanying drawings, which show presently preferred embodiments of the invention.

DESCRIPTION OF PRESENTLY PREFERRED EMBODIMENTS OF THE INVENTION

Figure 1:
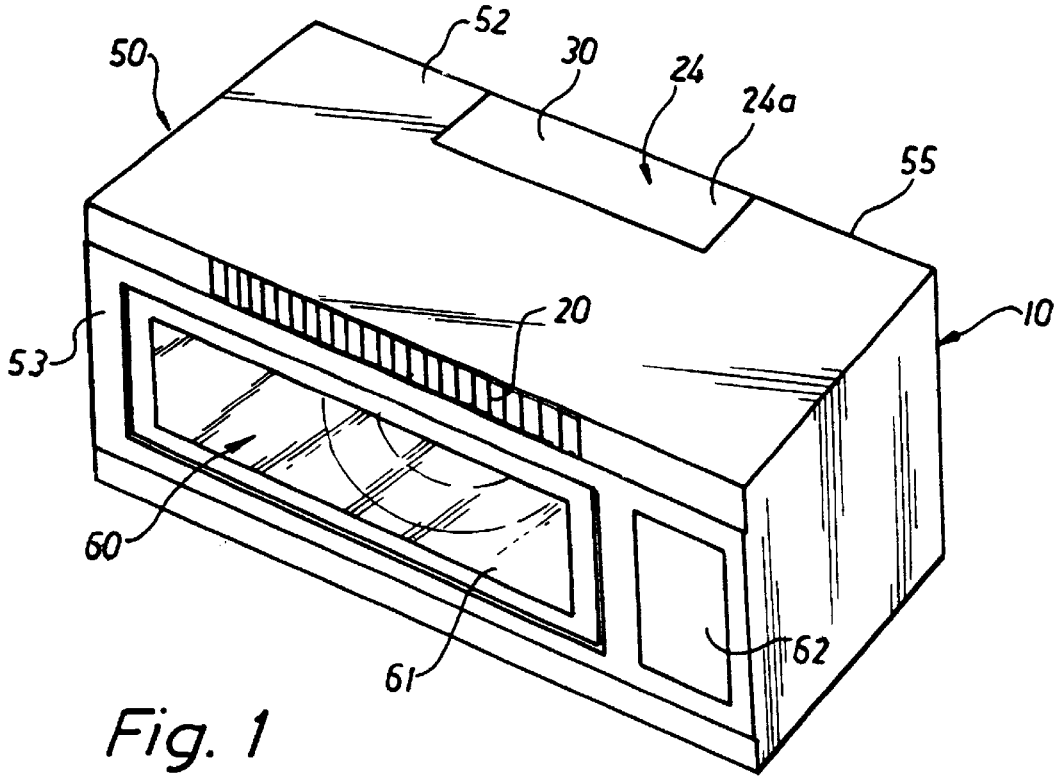
FIG. 1 shows a domestic appliance according to the invention in a perspective view obliquely from the front from above.
Figure 2:
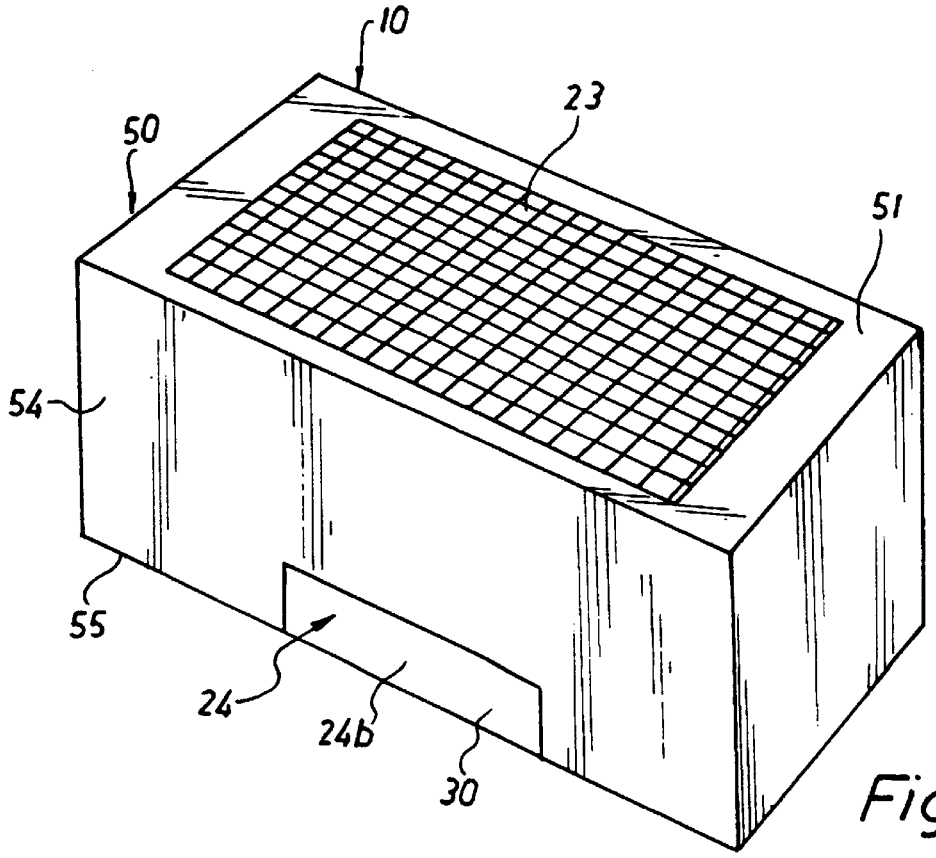
FIG. 2 shows the domestic appliance according to FIG. 1 in a perspective view obliquely from behind from below.
Figure 5:
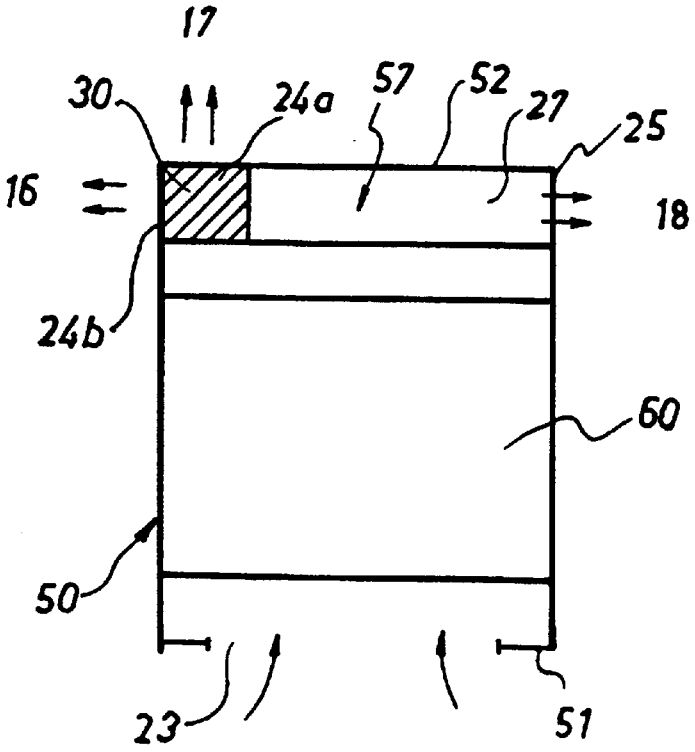
FIG. 5 is a schematic cross-section along the line V—V in FIG. 3 for illustrating the flow of air out from the appliance.

FIGS. 1 and 2 show a domestic appliance 10 which in one unit is a combination of a microwave oven and a ventilator hood (Over-the-range) to be located above a range. The appliance 10 comprises a casing 50 which has the form of a rectangular parallelepiped. On the front 53 of the casing 50 there is a door 61 for the microwave oven 60 and a control panel 62. On the underside 51 of the casing 50 there is an inlet opening 23 with a grate for the ventilator hood and on the back 54 and the top side 52 there is an outlet opening 24 extending along the intermediate edge 55, which opening is intended to be connected to a building kitchen flue located above or behind it, adjacent to an upper or a rear outlet location 24*a* or 24*b* respectively. In the embodiment shown, the shape of the outlet opening is specially adapted to a kitchen flue with a rectangular cross-section. On the front 53, there is also a second outlet opening 25, which is provided with a grate and intended for recirculation of air if the ventilator hood is used as a recirculating ventilator, e.g. when the building lacks suitable ventilating ducts. A ventilating duct extends in the casing 50 between the inlet opening 23 and the outlet openings 24 and 25. It can be seen from FIG. 5 that the air current is adjustable between three different outlet locations 24*b*, 24*a*, 25, each of which corresponds to a respective outlet route 16, 17, 18 for adjustment to the existence and location of kitchen flues in the building. The features described so far correspond to the features of a conventional type device.

Figure 3:
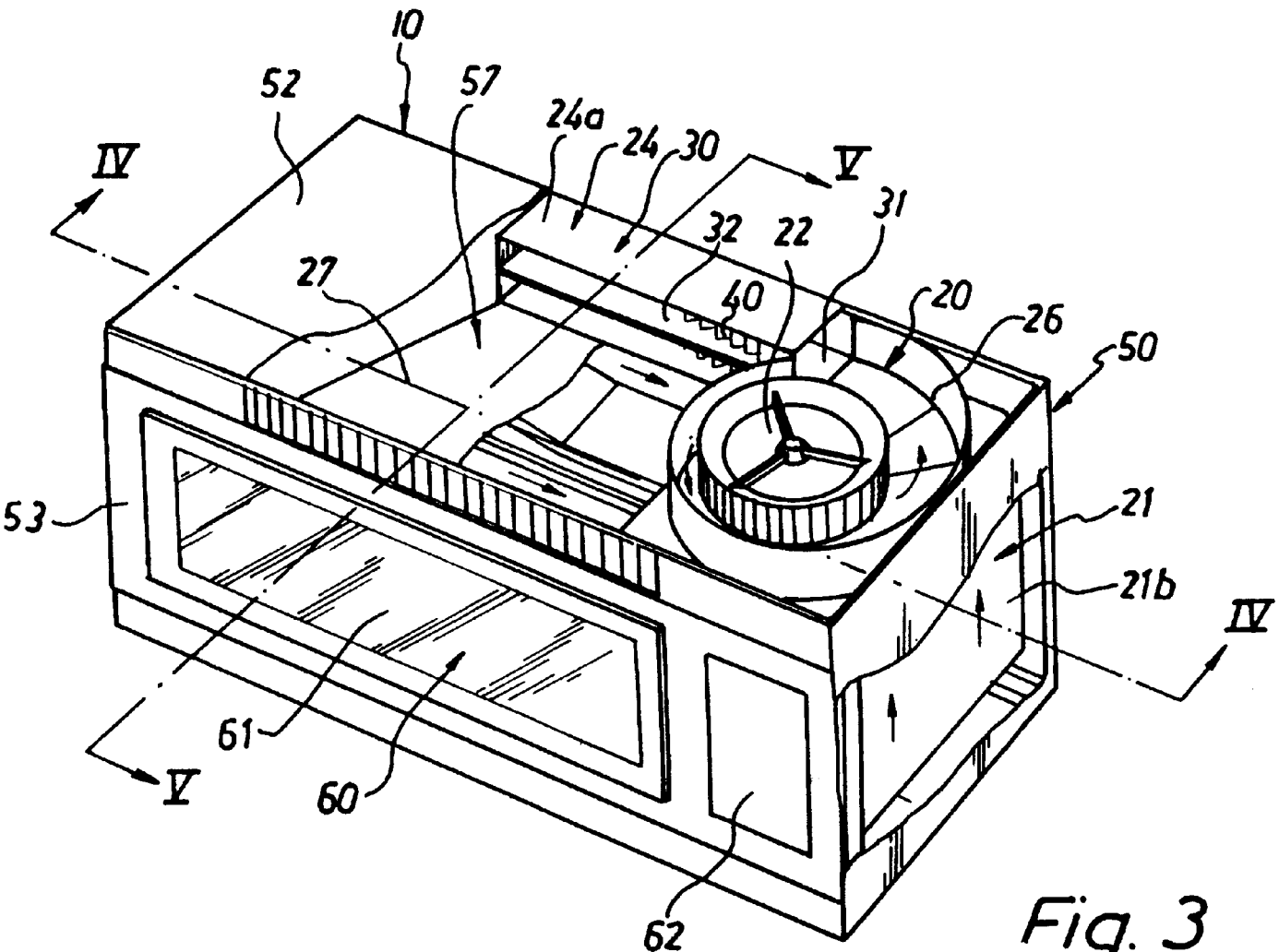
FIG. 3 shows the domestic appliance according to FIG. 1 with certain parts removed in order to illustrate the function of the appliance.

In FIG. 3, the appliance 10 is shown with certain parts cut away, which makes it possible to see an adjustable flow control means 30, which will be described in more detail below, and a radial ventilator 22, which is spaced from the outlet opening 24. Around the ventilator 22, there is a ventilator casing duct 26 which collects and guides the air current on the driving side of the ventilator to the flow control means 30. These parts form part of the ventilating duct 21 of the appliance 10. The flow control means 30, which is elongated is, e.g. in connection with the installation of the appliance, adjustable in the turning position around its longitudinal axis for adjustment of the outlet location and outlet route of the ventilating duct 21 according to FIG. 5.

Figure 4:
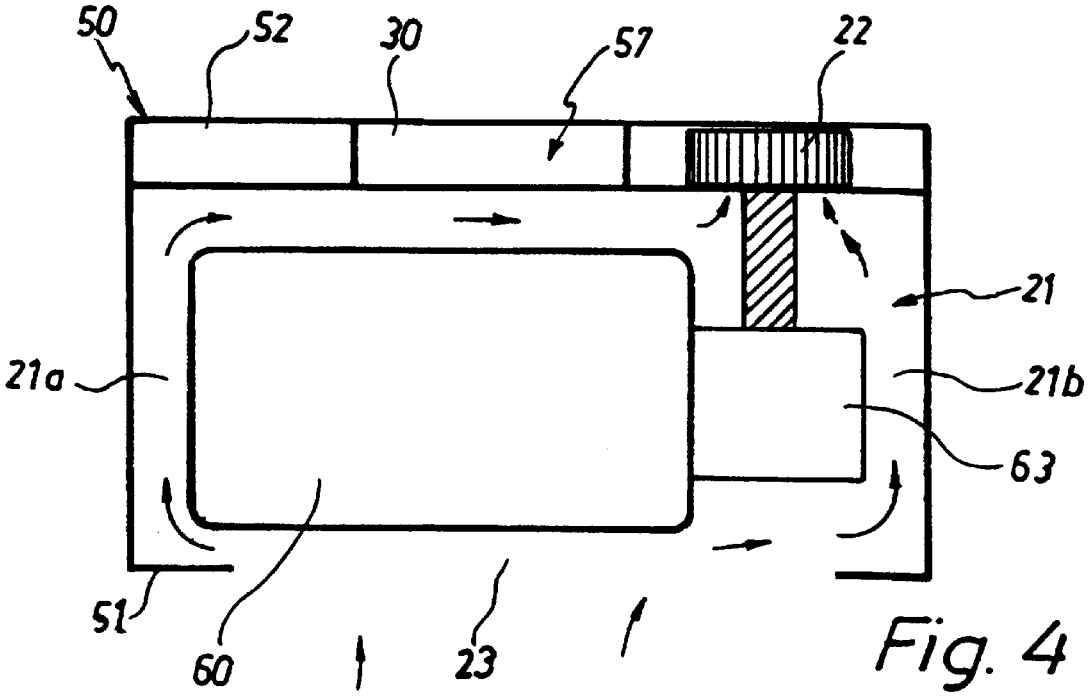
FIG. 4 is a schematic longitudinal section along the line IV—IV in FIG. 3 for illustrating the flow of air through the appliance.

The ventilator 22, the ventilator casing duct 26, the flow control means 30 and a recirculation duct 27, which extends between the flow control means 30 and the recirculation outlet 25, are all arranged in an upper plane 57 directly below the top side 52 of the casing 50. As can be most clearly seen in FIG. 4, this upper plane 57 is arranged above and spaced from the oven 60 in order to permit the supply of air between them. The ventilating duct 21 consists of the free volume in the casing 10 which is not taken up by the oven 60 and by drive components 63 for the oven and the ventilator. As can be seen in FIG. 4, the ventilating duct 21 with two sub-ducts 21*a* and 21*b* extends from the inlet opening 23 on one side around the oven 60 and on the other side around the drive components 63 of the appliance.

The location and design of the ventilator 22 shown in FIG. 3 offers many advantages. For example, it has been possible to give the ventilator 22 a large diameter, here in the range of ⅓ to ½ of the depth of the top side 52. Further, the asymmetric location of the ventilator 22 allows the motor to be located in the space beside the oven 60. The location of the ventilator 22 relatively close to the outlet opening permits the achievement of an even, directed flow in the ventilator casing duct 26 while the ventilating duct 21 can be made short on the driving side, i.e. the part which has to be particularly carefully sealed.

In addition, the risk of leakage of currents into the casing adjacent to the outlet opening 24, which has been a problem in known constructions, is reduced by the ventilator and in particular its intake being located spaced from it.

The embodiment shown with an elongated flow control means 30 in the outlet opening 24 is very well suited to be connected to kitchen flues with a rectangular cross-section. A major advantage in this connection is that a perpendicular and uniformly distributed flow is achieved over the whole area of the outlet opening, which leads to a small loss of energy and low sound levels.

Figure 6:
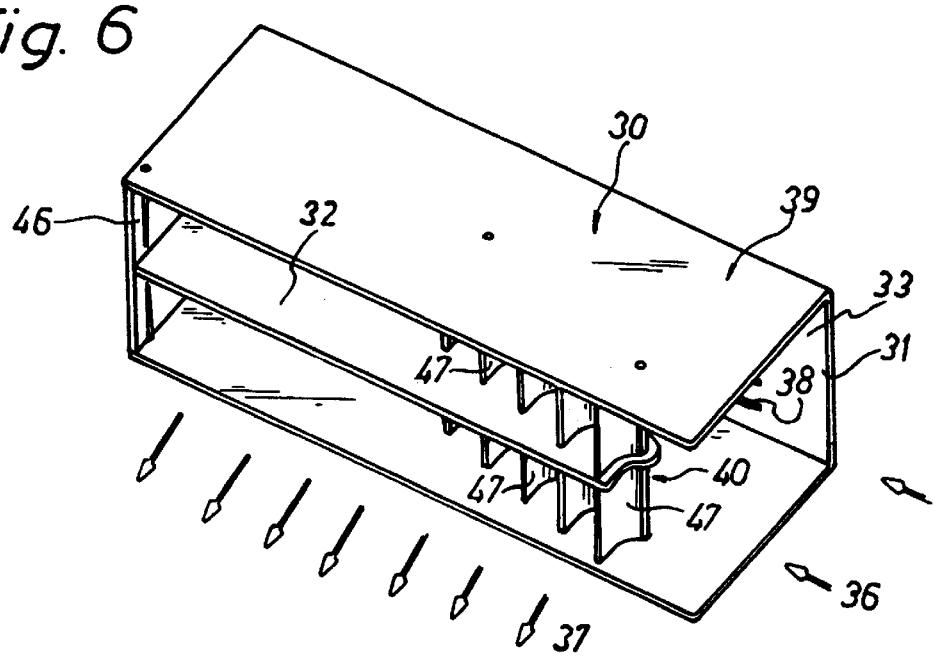
FIG. 6 is a perspective view of a flow control means according to the invention.

The flow control means 30 according to the invention is described in more detail below with reference to FIGS. 6 and 7. The ventilation control means 30 has two simultaneous functions, one being to function as a diffuser, and the other being to change the direction of the flow. By the ventilation control means 30 according to the invention, both these tasks are accomplished while, at the same time, a uniform flow is maintained along the outlet area of the ventilation control means 30.

The ventilation control means 30 has a control means housing 39 which is shaped like a rectangular parallelepiped with an inlet opening 31, which consists of a square short side. Furthermore, there is an outlet opening 32, which consists of a whole long side. The flow into and out of the flow control means 30 is indicated by flow arrows 36, 37. A deflecting device 40 comprising deflecting means in the form of deflecting blades 47 for deflecting the flow uniformly along a line extending diagonally in relation to the inlet as well as the outlet direction 36 and 37, respectively, extends in the ventilation control means 30.

Figure 7:
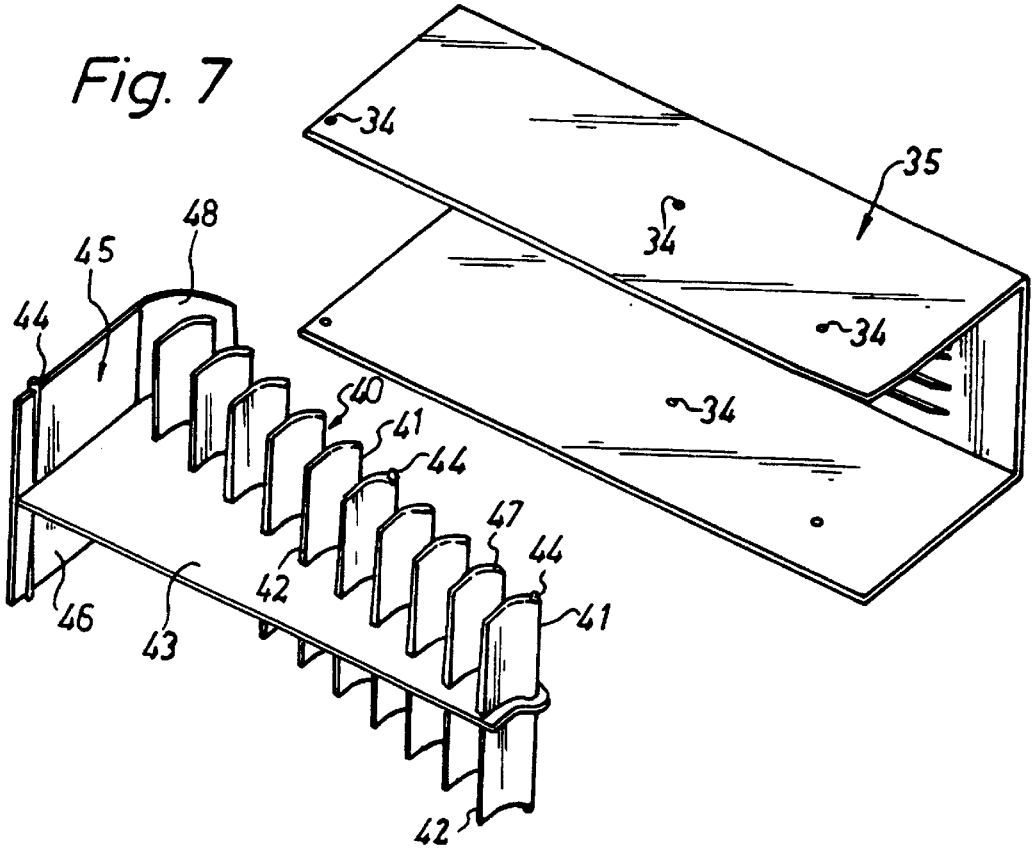
FIG. 7 shows the flow control means in FIG. 6 in a disassembled state.

FIG. 7 shows the flow control means 30 in a disassembled state, which means consists of an elongated cover 35 with a U-shaped cross-section and open short ends, as well as a deflecting unit 45, which in one piece incorporates deflecting blades 47, a holder device 43 for the deflecting blades 47 and a short side wall 46. The housing 39 of the control means is formed by the cover 35 and the short side wall 46.

The cover 35 is preferably made of plastic and has holder openings 34 for coaction with corresponding holder pins 44 on the deflecting unit 45 in the assembled state. Guide bars 38 are arranged on the inside of the cover 35 along the central long side 33 to guide the surface flow.

The deflecting unit 45, too, is preferably integrally formed in plastic and has a set of deflecting blades 47 uniformly located along a straight line. The holder device 43 consists of an essentially triangular flat plate extending perpendicular to the deflecting blades 47, parallel to the direction of flow. The holder device 43 is connected to the short side wall 46, perpendicular to the same.

The blades 47 are elongated transversely of and bent along the direction of flow and have a leading edge 41, which is rounded and when assembled faces the inlet opening 31, and a trailing edge 42, which is pointed and when assembled faces the outlet opening 32.

The holder pins 44 are formed on the ends of the blades 47 and on the short-side wall 46.

On the end which is turned away from the outlet opening 32, the short-side wall has a bent portion 48 for the smooth deflection of the flow along the inside surface of the flow control means 30.

The dividing of the flow control means into a cover and a deflecting unit allows for expedient and efficient manufacturing and assembly.

What is claimed is:

1. A domestic appliance comprising an oven (60) and a ventilator device (20), which are arranged in a casing (50), the ventilator device (20) comprising at least one inlet opening (23) and a plurality of outlet openings (24, 25) on the outside of the casing (50), a ventilating duct (21) extending between the inlet opening (23) and the plurality of outlet openings (24, 25), and a ventilator (22) arranged in the ventilating duct (21), the ventilating duct (21) being adjustable for leading out of the casing at any one of the plurality of outlet openings **(24*a*, 24*b*, 25), characterised in that the ventilator (22) is stationarily mounted in the casing (50) spaced from the plurality of outlet opening (24, 25), and the ventilating duct comprises a flow control means (30), which is arranged on the inside of the casing downstream of the ventilator (22) for adjustment between the plurality of outlet openings (24*a*, 24*b*, 25), the flow control means (30) includes an elongated control means housing (39) having a long side and a short side, the housing (39) is provided with an inlet (31) along the short side and an outlet (32) along the long side such that the outlet (32) having a larger area than the inlet (31), a deflecting device (40) is positioned within the control means housing (39) and is adapted to deflect and distribute essentially uniformly a flow from the inlet (31) to the outlet (32)**.

2. A domestic appliance according to claim 1, wherein the diameter of the ventilator (22) exceeds the smallest dimension of the outlet opening (24, 25) of the ventilating duct (21).

3. A domestic appliance according to claim 1, wherein the casing (50) essentially has the shape of a rectangular parallelepiped with an underside (51) and a top side (52), the inlet opening (24, 25) being arranged on the underside (51) and the outlet opening (24, 25) being arranged in an upper area of the casing (50) and the ventilator being a radial ventilator (22) which is adapted to rotate around a vertical axis (A) in the upper area of the casing (50).

4. A domestic appliance according to claim 3, wherein the outlet opening (24, 25) is centrally arranged in an upper portion of the casing (50), the ventilator (22) being asymmetrically arranged in relation thereto.

5. A domestic appliance according to claim 1, wherein the flow control means (30) is arranged along the outlet opening (24) of the ventilating duct (21).

6. A domestic appliance comprising an oven and a ventilator device, which are arranged in a casing, the ventilator device (20) comprising:

at least one inlet opening and a plurality of outlet openings on the outside of the casing, a ventilating duct extending between the inlet opening and the plurality of outlet openings, a ventilator arranged in the ventilating duct, the ventilator being stationarily mounted in the ventilating duct spaced from the plurality of outlet openings, a flow control housing forming part of the ventilating duct, the housing being arranged on the inside of the casing downstream of the ventilator for adjustment between the plurality of outlet openings, wherein the flow control housing is elongated and has a long side and a short side, the housing is provided with a housing inlet along the short side and a housing outlet along the long side such that the housing outlet has a larger area than the housing inlet, a deflecting device is supported within the housing and forms part of the flow control housing, the deflecting device is adapted to deflect and distribute essentially uniformly a flow from the housing inlet to the housing outlet.

7. A domestic appliance according to claim 6, wherein the deflecting device comprises a plurality of deflecting blades which are uniformly arranged within the flow control housing, the deflecting blades are curved and have a leading edge facing the inlet opening and a trailing edge facing the outlet opening.

8. A domestic appliance according to claim 7, wherein the leading edge of the blades is rounded and the trailing edge is pointed.

* * * * *